US005780156A

United States Patent [19]

Hoyt et al.

[11] Patent Number: 5,780,156

[45] Date of Patent: Jul. 14, 1998

[54] BIOCOMPONET FIBERS HAVING DISTINCT CRYSTALINE AND AMORPHOUS POLYMER DOMAINS AND METHOD MAKING SAME

[75] Inventors: Matthew B. Hoyt; Diane R. Kent, both of Arden; James R. Bristow, Asheville, all of N.C.

[73] Assignee: BASF Corporation, Mt. Olive, N.J.

[21] Appl. No.: 725,417

[22] Filed: Oct. 3, 1996

[51] Int. Cl.[6] ..... D02G 3/00

[52] U.S. Cl. ..... 428/373; 428/374

[58] Field of Search ..... 428/320, 373, 428/374

[56] References Cited

U.S. PATENT DOCUMENTS

| | | | |
|---|---|---|---|
| 3,017,686 | 1/1962 | Breen et al. | 428/373 |
| 3,700,544 | 10/1972 | Mutsui | 428/373 |
| 3,718,534 | 2/1973 | Okamoto et al. | 428/374 |
| 3,803,453 | 4/1974 | Hull | 428/373 |
| 4,496,619 | 1/1985 | Okamoto | 428/224 |
| 4,743,505 | 5/1988 | Yamada et al. | 428/373 |
| 4,756,969 | 7/1988 | Takeda | 428/372 |
| 4,997,712 | 3/1991 | Lin | 428/372 |
| 5,125,818 | 6/1992 | Yeh | 425/131.5 |
| 5,147,704 | 9/1992 | Lin | 428/97 |
| 5,162,074 | 11/1992 | Hills | 156/644 |
| 5,294,482 | 3/1994 | Gessner | 428/287 |
| 5,327,714 | 7/1994 | Stevens et al. | 57/230 |
| 5,344,297 | 9/1994 | Hills | 425/131.5 |
| 5,445,884 | 8/1995 | Hoyt et al. | 428/370 |
| 5,512,355 | 4/1996 | Fuson | 428/244 |
| 5,518,812 | 5/1996 | Mitchnick et al. | 428/357 |
| 5,534,339 | 7/1996 | Stokes | 428/373 |
| 5,549,957 | 8/1996 | Negola et al. | 428/92 |
| 5,550,192 | 8/1996 | Sheth et al. | 525/194 |
| 5,560,804 | 10/1996 | Ochi et al. | 428/374 |

*Primary Examiner*—Newton Edwards

[57] ABSTRACT

Novel bicomponent fibers have a polyamide domain and an amorphous non-fiber-forming polymer domain which is embedded entirely within, and thereby completely surrounded by, the polyamide domain. The preferred bicomponent fibers have a sheath-core structure wherein the polyamide domain constitutes the sheath and the amorphous non-fiber-forming polymer constitutes the core. Surprisingly, even though the core is formed of a non-fiber-forming polymer, the bicomponent fibers exhibit properties which are comparable in many respects to fibers formed from 100% polyamide. Preferably, the fibers are concentric sheath-core bicomponent fibers having a nylon sheath and a core formed from polystyrene, polyisobutene and poly (methyl methacrylate). Polystyrene, and particularly atactic polystyrene, is preferred as the amorphous polymer domain.

10 Claims, No Drawings

BIOCOMPONET FIBERS HAVING DISTINCT CRYSTALINE AND AMORPHOUS POLYMER DOMAINS AND METHOD MAKING SAME

CROSS-REFERENCE TO RELATED APPLICATIONS

This application may be deemed related to commonly owned, pending U.S. patent application Ser. No.08,725,920 (Atty. Dkt. No. 1005-89) filed even date herewith, the entire content of which is expressly incorporated hereinto by reference.

FIELD OF INVENTION

The present invention relates generally to the field of synthetic fibers. More particularly, the present invention relates to synthetic bicomponent fibers having a sheath-core structure. In particularly preferred forms, the present invention is embodied in multi-lobal bicomponent fibers having a polyamide sheath entirely surrounding a core formed of an amorphous polymer.

BACKGROUND AND SUMMARY OF THE INVENTION

Polyamide has been utilized extensively as a synthetic fiber. While its structural and mechanical properties make it attractive for use in such capacities as carpeting, it is nonetheless relatively expensive. It would therefore be desirable to replace a portion of polyamide fibers with a core formed from a relatively lower cost non-polyamide material. However, replacing a portion of a 100% polyamide fiber with a core portion of a relatively less expensive non-polyamide material may affect the mechanical properties of the fiber to an extent that it would no longer be useful in its intended end-use application (e.g., as a carpet fiber).

Recently, U.S. Pat. No. 5,549,957 has proposed multi-lobal composite fibers having a nylon sheath and a core of a fiber-forming polymer which can be, for example, "off spec" or reclaimed polymers. (Column 4, lines 6–8.) The core can be polypropylene, polyethylene terephthalate, high density polyethylene, polyester or polyvinyl chloride. (Column 4, lines 17–20.) The core is covered with a sheath of virgin nylon which constitutes between 30% to 50% by weight of the core/sheath fiber. (Column 3, lines 65–67.)

Certain amorphous (non-crystalline) polymers, such as polystyrene, represent attractive polymers due to their lower cost as compared to virgin nylon. However, polystyrene is not considered to be a fiber-forming polymer. A minor amount of polystyrene, however, has been blended with an otherwise fiber-forming polymer (e.g., nylon or polypropylene) when forming electrically conductive sheath-core fibers according to U.S. Pat. No. 5,147,704.

Furthermore, U.S. Pat. No. 3,718,534 to Okamoto et al disclose that conjugate fibers may be formed from at least two different fiber-forming polymers (see, column 6, lines 53–63), including polyamides, and a so-called uniting constituent, including polystyrene, which is exposed at the surface of the fiber so as to be easily dissolved by a solvent. Dissolution of the uniting constituent thereby leaves the co-spun fiber-forming constituents present in the final fiber product.

The presently known prior art therefore evidences the fact that non-fiber-forming amorphous polymers, such as amorphous polystyrene, have not been employed as a structural component of finished bicomponent synthetic fiber structures.

Broadly, the present invention relates to a bicomponent fiber structure having a polyamide domain and another distinct cross-sectional domain formed of an amorphous non-fiber-forming polymer. The amorphous polymer domain is embedded entirely within, and thus completely surrounded by, the polyamide domain. Preferably, the fibers of this invention have a concentric sheath-core structure whereby the polyamide domain forms the sheath and the amorphous non-fiber-forming polymer forms the core. Surprisingly, even though the core is formed of a non-fiber-forming amorphous polymer, the bicomponent sheath-core fibers of this invention exhibit properties which are comparable in many respects to fibers formed from 100% polyamide.

DETAILED DESCRIPTION OF THE PREFERRED EXEMPLARY EMBODIMENTS

As used herein and in the accompanying claims, the term "fiber-forming" is meant to refer to at least partly oriented, partly crystalline, linear polymers which are capable of being formed into a fiber structure having a length at least 100 times its width and capable of being drawn without breakage at least about 10%. The term "non-fiber-forming" is therefore meant to refer to amorphous (non-crystalline) linear polymers which may be formed into a fiber structure, but which are incapable of being drawn without breakage at least about 10%.

The term "fiber" includes fibers of extreme or indefinite length (filaments) and fibers of short length (staple). The term "yarn" refers to a continuous strand or bundle of fibers.

The term "bicomponent fiber" is a fiber having at least two distinct cross-sectional domains respectively formed of different polymers. The term "bicomponent fiber" is thus intended to include concentric and eccentric sheath-core fiber structures, symmetric and asymmetric side-by-side fiber structures, island-in-sea fiber structures and pie wedge fiber structures. Preferred according to the present invention are concentric bicomponent sheath-core fiber structures having a polyamide sheath and a non-fiber-forming amorphous polymer core, and thus the disclosure which follows will be directed to such a preferred embodiment. However, the present invention is equally applicable to other bicomponent fiber structures having a polyamide domain and a non-fiber-forming amorphous polymer domain embedded entirely within, and thus completely surrounded by, the polyamide domain.

The term "linear polymer" is meant to encompass polymers having a straight chain structure wherein less than about 10% of the structural units have side chains and/or branches.

The preferred polyamides useful to form the sheath of the bicomponent fibers of this invention are those which are generically known by the term "nylon" and are long chain synthetic polymers containing amide (—CO—NH—) linkages along the main polymer chain. Suitable melt spinnable, fiber-forming polyamides for the sheath of the sheath-core bicomponent fibers according to this invention include those which are obtained by the polymerization of a lactam or an amino acid, or those polymers formed by the condensation of a diamine and a dicarboxylic acid. Typical polyamides useful in the present invention include nylon 6, nylon 6/6, nylon 6/9, nylon 6/10, nylon 6T, nylon 6/12, nylon 11, nylon 12, nylon 4,6 and copolymers thereof or mixtures thereof. Polyamides can also be copolymers of nylon 6 or nylon 6/6 and a nylon salt obtained by reacting a dicarboxylic acid component such as terephthalic acid, isophthalic acid, adipic acid or sebacic acid with a diamine such as hexamethylene diamine, methaxylene diamine, or 1,4-bisaminomethylcyclohexane. Preferred are poly-ε-caprolactam (nylon 6) and polyhexamethylene adipamide (nylon 6/6). Most preferred is nylon 6.

Importantly, the core of the sheath-core fibers according to this invention is formed of an amorphous linear polymer which in and of itself is non-fiber-forming. Suitable amorphous polymers for use in the practice of this invention include polystyrene, polyisobutene and poly(methyl methacrylate). Preferably, the core is formed of amorphous polystyrene, with amorphous atactic polystyrene being particularly preferred.

The core will represent less than about 50% by weight of the fibers according to this invention, with the sheath representing greater than about 50 wt. %. More preferably, the core will be less than about 30 wt. % of the fibers according to this invention, with the sheath being present in the fibers in an amount greater than about 70 wt. %. Particular preferred are fibers having a sheath of at least 75 wt. % nylon and a core of less than about 25 wt. % amorphous non-fiber-forming polymer. Thus, weight ratios of the sheath to the core in the fibers of this invention may range from about 1:1 to about 10:1, with a ratio of greater than about 2: 1, and more preferably greater than about 3:1 being preferred.

The sheath-core fibers are spun using conventional fiber-forming equipment. Thus, for example, separate melt flows of the sheath and core polymers may be fed to a conventional sheath-core spinnerette pack such as those described in U.S. Pat. Nos. 5,162,074, 5,125,818, 5,344,297 and 5,445,884 (the entire content of each patent being incorporated expressly hereinto by reference) where the melt flows are combined to form extruded multi-lobal (e.g., tri-, tetra-, penta- or hexalobal) fibers having sheath and core structures. Preferably, the fibers have a tri-lobal structure with a modification ratio of at least about 1.4, more preferably between 2 and 4. In this regard, the term "modification ratio" means the ratio $R_1/R_2$, where $R_2$ is the radius of the largest circle that is wholly within a transverse cross-section of the fiber, and $R_1$ is the radius of the circle that circumscribes the transverse cross-section.

The extruded fibers are quenched, for example with air, in order to solidify the fibers. The fibers may then be treated with a finish comprising a lubricating oil or mixture of oils and antistatic agents. The thus formed fibers are then combined to form a yarn bundle which is then wound on a suitable package.

In a subsequent step, the yarn is drawn and texturized to form a bulked continuous fiber (BCF) yarn suitable for tufting into carpets. A more preferred technique involves combining the extruded or as-spun fibers into a yarn, then drawing, texturizing and winding into a package all in a single step. This one-step method of making BCF is generally known in the art as spin-draw-texturing (SDT).

Nylon fibers for the purpose of carpet manufacturing have linear densities in the range of about 3 to about 75 denier/filament (dpf) (denier=weight in grams of a single fiber with a length of 9000 meters). A more preferred range for carpet fibers is from about 15 to 25 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing is then coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is to apply a secondary backing, generally a woven jute or woven synthetic such as polypropylene. Preferably, carpets for floor covering applications will include a woven polypropylene primary backing, a conventional SB latex formulation, and either a woven jute or woven polypropylene secondary carpet backing. The SB latex can include calcium carbonate filler and/or one or more the hydrate materials listed above.

While the discussion above has emphasized the fibers of this invention being formed into bulked continuous fibers for purposes of making carpet fibers, the fibers of this invention can be processed to form fibers for a variety of textile applications. In this regard, the fibers can be crimped or otherwise texturized and then chopped to form random lengths of staple fibers having individual fiber lengths varying from about 1½ to about 8 inches.

The fibers of this invention can be dyed or colored utilizing conventional fiber-coloring techniques. For example, the fibers of this invention may be subjected to an acid dye bath to achieve desired fiber coloration. Alternatively, the nylon sheath may be colored in the melt prior to fiber-formation (i.e., solution dyed) using conventional pigments for such purpose.

A further understanding of this invention will be obtained from the following non-limiting Examples which illustrate specific embodiments thereof.

EXAMPLES

Physical properties for the samples in the Examples below were obtained using the following test procedures:

Measured Linear Density (denier): The linear density of the fibers was determined using ASTM D1059, where the length of yarn used was 90 cm.

Shrinkage (Autoclave or Superba): Shrinkage was computed using the linear densities before and after the autoclave or Superba heatsetting of the yarn by the formula:

$$(d_{after}-d_{before})/d_{after}$$

where $d_{before}$ and $d_{after}$ are respectively the linear densities before and after the autoclave or Superba heatsetting.

Vetterman Drum Wear: The Vetterman Drum test simulated wear according to ASTM D5417. The degree of wear exhibit by the samples is determined by a visual rating relative to photographic standards of wear from The Carpet and Rug Institute (CRI Reference Scale available from CRI, P.O. Box 2048, Dalton, Ga., U.S.A.). Each of the common types of carpet construction has a corresponding set of photographic examples of unworn and worn samples. The wear levels are from 5 to 1, where 5 represents no visible wear and 1 represents considerable wear.

Boiling Water Shrinkage: Boiling water shrinkage was determined using ASTM D2259-1987.

Pile Height Retention: Pile height retention was measured on trafficked carpet samples using a compressometer manufactured by Schiefer having a 0.5 psi load and a 1 square inch surface area pressure foot. The height of the untrafficked carpet sample was first measured at 12 locations within the carpet sample using a template to ensure the sample locates are measured after trafficking. The samples rested for 24 hours after trafficking and were then vacuumed. After resting an additional 48 hours, the pile height of the trafficked carpet sample was determined. The average of the 12 final measurements was divided by the average of the original 12 measurements and multiplied by 100 to give the percent pile height retained. Testing and measurements were conducted at 70° F. and 65% relative humidity.

Static Compression: The static compression was determined by testing four samples from the material. Initial pile height of each carpet sample was determined under a load of 0.5 psi using the compressometer and methods as described above in determining Pile Height Retention. The Carpet was compressed for 24 hours under 50 psi. The compression force was then removed and the carpet vacuumed and allowed to recover with no loading for another 24 hours, following which the final reading was done. The result was the average for the four samples reported as a percent of the original pile height. Testing and measurements were conducted at 70° F. and 65% relative humidity.

Example 1 (Comparative)

Nylon 6 (available from BASF Corp. as Ultramid® BS-700F) was extruded at 270° C. into a modified trilobal cross section-58 filaments 1100 denier to overall yarn. Winding speed was 2400 meters per minute. Yarn was processed in a one step method in which the yarn is extruded, drawn, and textured in a continuous process. Two of these yarns were then combined in a cable twisting operation. The cabled yarn had a 3.75 twist per inch "S" twist. Skeins of the cabled yarn were heat set in an water autoclave using a temperature cycle of 270° F.–230° F.–270° F.–230° F.–270° F.

The yarn was then tufted on an 1/8th gauge carpet tufting machine to a pile height of 9/16" and weight of 35 oz. of face fiber per square yard of carpet. Carpet was then dyed to a light brown shade on a continuous dye range. This carpet then had latex and a secondary backing applied.

The physical properties of the yarn and tufted carpet are noted below in Table 1.

Example 2 (Invention)

The nylon 6 resin described in example 1 was extruded at 270° C. Polystyrene (BASF PS2820 unfilled, nominal melt flow of 20 @200° C., 5000 g using ASTM D1238 - cond. G) was extruded at a polymer temperature of 270° C. These polymers were combined in a sheath-core bicomponent fiber spin pack. The polystyrene resin was channeled into the core of 58 filaments using thin etched plates such as those described in U.S. Pat. No. 5,344,297 to Hills and U.S. Pat. No. 5,445,884 to Hoyt et al (the entire content of each patent being expressly incorporated hereinto by reference). The combined melt polymer flows were passed through the same trilobal capillary and orifice as in example 1. Metering of the two polymer flows was controlled to produce a 85:15 weight ratio of nylon 6 sheath to polystyrene core. The yarn was drawn and textured in a continuous process, resulting in a 1100 denier 58 filament yarn. This yarn was cabled and heat set (autoclaved) and tufted in to carpet as described in Example 1. Physical properties of the yarn and carpet are noted below in Table 1.

Example 3 (Invention)

Example 2 was repeated except that the weight ratio of nylon 6 to polystyrene was 80:20. The yarn of this Example 2 was cabled, heat set (autoclaved) and tufted into carpet as described in Example 1. Physical properties of the yarn and carpet are noted below in Table 1.

Example 4 (Invention)

Example 2 was repeated, except that the weight ratio of nylon 6 to polystyrene was 75:25. This yarn was cabled, heat set (autoclaved) and tufted into carpet as described in Example 1. Physical properties of the yarn and carpet are noted below in Table 1.

Example 5 (Invention)

Example 2 was repeated, except that the weight ratio of nylon 6 to polystyrene was 70:30. This yarn was cabled, heat set (autoclaved) and tufted into carpet as described in Example 1. Physical properties of the yarn and carpet are noted below in Table 1.

Example 6 (Comparative)

Nylon 6 (available from BASF Corp. as Ultramid® BS-700F) was extruded at 270° C. into a modified trilobal cross section—58 filaments 1300 denier to overall yarn. Winding speed was 2400 meters per minute. Yarn was processed in a one step method in which the yarn is extruded, drawn, and textured in a continuous process. Two ends of this yarns were then combined in a cable twisting operation to obtain a cabled yarn with 4.5 twists per "S" twist. This cabled yarn was heat set using steam in a Superba heat set tunnel at a 255° C. process temperature.

The yarn was then tufted on an 1/8th gauge carpet tufting machine into both 30 oz/sq. yard and 45 oz/sq. yd. carpets with pile heights of 9/16ths and 11/16ths respectively.

Example 7 (Comparative)

Example 6 was repeated, except that the heat set yarns were stuffer box textured before tufting into carpets.

Example 8 (Invention)

Example 6 was repeated except that the yarn was comprised of sheath-core bicomponent fibers having a nylon sheath and a polystyrene (BASF PS2820) core in a weight ratio of 75:25. The sheath-core bicomponent fibers were manufactured using the same yarn extrusion process and equipment as in Examples 2–5.

Example 9 (Invention)

Example 8 was repeated, except that the heat set yarns were stuffer box textured before tufting into carpets.

Examples 6–9 all formed carpets with no processing difficulties noted for any of the yarns.

TABLE 1

| | Ex. 1 | Ex. 2 | Ex. 3 | Ex. 4 | Ex. 5 |
|---|---|---|---|---|---|
| Uncabled Single Yarn | | | | | |
| Measured Linear Density (denier) | 1276 | 1343 | 1221 | 1235 | 1246 |
| Elongation to Break (%) | 43.7 | 48.8 | 51.0 | 45.2 | 48 |
| Tenacity (g/denier) | 2.90 | 1.86 | 2.29 | 1.83 | 1.85 |
| Modulus @ 5% Extension (g/denier) | 4.79 | 6.19 | 5.24 | 6.67 | 7.43 |
| Boiling Water Shrinkage | 8.7 | 7.0 | 6.4 | 6.0 | 5.4 |

TABLE 1-continued

| | Ex. 1 | Ex. 2 | Ex. 3 | Ex. 4 | Ex. 5 |
|---|---|---|---|---|---|
| Heat set Untwisted Yarn | | | | | |
| Measured Linear Denier | 1557 | 1649 | 1466 | 1501 | 1504 |
| Autoclave Shrinkage (%) | 18.0 | 18.6 | 16.7 | 17.7 | 17.1 |
| Carpets | | | | | |
| Vettermann Drum (5000 cycles): | | | | | |
| (a) Visual Ranking | 3.5 | 3.5 | 3.0 | 3.0 | 2.5 |
| (b) Pile Height Retention (%) | 97 | 95 | 95 | 94 | 93 |
| Static Compression (%) | 96 | 90 | 95 | 95 | 91 |

TABLE 2

| | Exs. 6/7 | Exs. 8/9 |
|---|---|---|
| Uncabled Single Yarn | | |
| Measured Linear Density (denier) | 1344 | 1314 |
| Elongation to Break (%) | 36.7 | 44.8 |
| Tenacity (g/denier) | 2.65 | 2.27 |
| Modulus @ 5% Extension (g/denier) | 7.53 | 7.17 |
| Cabled Unheatset Yarn | | |
| Denier (singles) | 1358 | 1327 |
| Denier (plied) | 2720 | 2675 |
| Heat set Untwisted Yarn | | |
| Measured Linear Density - singles (denier) | | |
| (a) Straight Set | 1698 | 1685 |
| (b) Stuffer Box | 1697 | 1601 |
| Measured Linear Density - plied (denier) | | |
| (a) Straight Set | 3452 | 3307 |
| (b) Stuffer Box | 3425 | 3171 |
| Superba Shrinkage (%) - Singles | | |
| (a) Straight Set | 0.20 | 0.21 |
| (b) Stuffer Box | 0.20 | 0.17 |
| Superba Shrinkage (%) - Plied | | |
| (a) Straight Set | 0.21 | 0.19 |
| (b) Stuffer Box | 0.20 | 0.16 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bicomponent fiber comprising distinct cross-sectional domains, wherein one domain comprises a fiber-forming polyamide and one domain comprises a non-fiber-forming amorphous polymer and wherein the non-fiber-forming amorphous polymer is substantially surrounded by the fiber-forming polyamide.

2. A fiber as in claim 1, wherein the amorphous polymer is selected from the group consisting of amorphous polystyrene, amorphous polyisobutene and amorphous poly (methyl methacrylate).

3. A fiber as in claim 1, wherein the amorphous polymer is atactic polystyrene.

4. A fiber as in claim 1, wherein polyamide domain is a nylon selected from the group consisting of nylon 6, nylon 6/6, nylon 6/9, nylon 6/10, nylon 6T, nylon 6/12, nylon 11, nylon 12, nylon 4,6 and copolymers thereof or mixtures thereof.

5. A fiber as in claim 1, in the form of a sheath-core bicomponent fiber, wherein the sheath comprises nylon and the core comprises amorphous polystyrene.

6. A fiber as in claim 5, wherein the nylon sheath is nylon 6 or nylon 6/6.

7. A fiber as in claim 6, wherein the sheath comprises at least 50% by weight of the fiber and the core comprises less than 50% by weight of the fiber.

8. A fiber as in claim 7, wherein the sheath comprises at least 70% by weight of the fiber, and the core comprises less than about 30% by weight of the fiber.

9. A fiber as in claim 1, which is drawn without breakage at least about 10%.

10. A fiber as in claim 1, which is a staple fiber.

* * * * *